US006196509B1

(12) United States Patent
Clemens

(10) Patent No.: US 6,196,509 B1
(45) Date of Patent: Mar. 6, 2001

(54) REMOTE CONTROLLER HOLDER

(76) Inventor: Marvin F. Clemens, 2619 E. Hemstead Cir., Anaheim, CA (US) 92806

( * ) Notice: Subject to any disclaimer, the term of this patent is extended or adjusted under 35 U.S.C. 154(b) by 0 days.

(21) Appl. No.: 09/345,855

(22) Filed: Jul. 1, 1999

(51) Int. Cl.[7] ..... A47H 1/16

(52) U.S. Cl. ..... 248/302; 248/211; 248/215; 248/290.1; 248/305

(58) Field of Search ..... 248/302, 211, 248/215, 234, 290.1, 304, 305

(56) References Cited

U.S. PATENT DOCUMENTS

D. 423,269 * 4/2000 Laga et al. ..... D6/566
D. 423,337 * 4/2000 Laga et al. ..... D8/372
3,429,541 * 2/1969 Herman ..... 211/42 X
4,083,312 * 4/1978 Holman, Jr. ..... 248/215 X
5,074,419 * 12/1991 Smith ..... 248/215 X

* cited by examiner

*Primary Examiner*—Anita M. King
*Assistant Examiner*—A. Joseph Wujciak

(57) ABSTRACT

A remote controller holder for permitting hands free holding a remoter controller by a user. The remote controller holder includes an elongate carrier having spaced apart pair of arm portions and an elongate middle portion connecting the arm portions together. The arm portions each have spaced apart elongate front and back segments, and an elongate bottom segment connecting the front and back segments of the respective arm portion together. The back segments of the arm portions are coupled to the middle portion. The arm portions are designed for resting a remote controller thereon. A generally U-shaped bracket is coupled to the middle portion of the elongate carrier. A bolt is extended through the bracket. The bolt is designed for extending through a looped end of a neck strap secured around a user's neck.

12 Claims, 2 Drawing Sheets

REMOTE CONTROLLER HOLDER

BACKGROUND OF THE INVENTION

1. Field of the Invention

The present invention relates to remote controller holders and more particularly pertains to a new remote controller holder for permitting hands free holding a remoter controller by a user.

2. Description of the Prior Art

The use of remote controller holders is known in the prior art. More specifically, remote controller holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,537,340; U.S. Pat. No. 5,551,615; U.S. Pat. No. 3,541,976; U.S. Pat. No. 3,273,484; U.S. Pat. No. 4,699,415; and U.S. Pat. No. Des. 377,876.

While these devices fulfill their respective, particular objectives and requirements, the aforementioned patents do not disclose a new remote controller holder. The inventive device includes an elongate carrier having spaced apart pair of arm portions and an elongate middle portion connecting the arm portions together. The arm portions each have spaced apart elongate front and back segments, and an elongate bottom segment connecting the front and back segments of the respective arm portion together. The back segments of the arm portions are coupled to the middle portion. The arm portions are designed for resting a remote controller thereon. A generally U-shaped bracket is coupled to the middle portion of the elongate carrier. A bolt is extended through the bracket. The bolt is designed for extending through a looped end of a neck strap secured around a user's neck.

In these respects, the remote controller holder according to the present invention substantially departs from the conventional concepts and designs of the prior art, and in so doing provides an apparatus primarily developed for the purpose of permitting hands free holding a remoter controller by a user.

SUMMARY OF THE INVENTION

In view of the foregoing disadvantages inherent in the known types of remote controller holders now present in the prior art, the present invention provides a new remote controller holder construction wherein the same can be utilized for permitting hands free holding a remoter controller by a user.

The general purpose of the present invention, which will be described subsequently in greater detail, is to provide a new remote controller holder apparatus and method which has many of the advantages of the remote controller holders mentioned heretofore and many novel features that result in a new remote controller holder which is not anticipated, rendered obvious, suggested, or even implied by any of the prior art remote controller holders, either alone or in any combination thereof.

To attain this, the present invention generally comprises an elongate carrier having spaced apart pair of arm portions and an elongate middle portion connecting the arm portions together. The arm portions each have spaced apart elongate front and back segments, and an elongate bottom segment connecting the front and back segments of the respective arm portion together. The back segments of the arm portions are coupled to the middle portion. The arm portions are designed for resting a remote controller thereon. A generally U-shaped bracket is coupled to the middle portion of the elongate carrier. A bolt is extended through the bracket. The bolt is designed for extending through a looped end of a neck strap secured around a user's neck.

There has thus been outlined, rather broadly, the more important features of the invention in order that the detailed description thereof that follows may be better understood, and in order that the present contribution to the art may be better appreciated. There arc additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new remote controller holder apparatus and method which has many of the advantages of the remote controller holders mentioned heretofore and many novel features that result in a new remote controller holder which is not anticipated, rendered obvious, suggested, or even implied by any of the prior art remote controller holders, either alone or in any combination thereof.

It is another object of the present invention to provide a new remote controller holder which may be easily and efficiently manufactured and marketed.

It is a further object of the present invention to provide a new remote controller holder which is of a durable and reliable construction.

An even further object of the present invention is to provide a new remote controller holder which is susceptible of a low cost of manufacture with regard to both materials and labor, and which accordingly is then susceptible of low prices of sale to the consuming public, thereby making such remote controller holder economically available to the buying public.

Still yet another object of the present invention is to provide a new remote controller holder which provides in the apparatuses and methods of the prior art some of the advantages thereof, while simultaneously overcoming some of the disadvantages normally associated therewith.

Still another object of the present invention is to provide a new remote controller holder for permitting hands free holding a remoter controller by a user.

Yet another object of the present invention is to provide a new remote controller holder which includes an elongate carrier having spaced apart pair of arm portions and an elongate middle portion connecting the arm portions together. The arm portions each have spaced apart elongate front and back segments, and an elongate bottom segment connecting the front and back segments of the respective arm portion together. The back segments of the arm portions are coupled to the middle portion. The arm portions are designed for resting a remote controller thereon. A generally U-shaped bracket is coupled to the middle portion of the elongate carrier. A bolt is extended through the bracket. The bolt is designed for extending through a looped end of a neck strap secured around a user's neck.

Still yet another object of the present invention is to provide a new remote controller holder that helps hold a remote controller for remote controlled models including remote controlled model airplanes, cars and boats at a comfortable angle for the user to use the remote controller.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
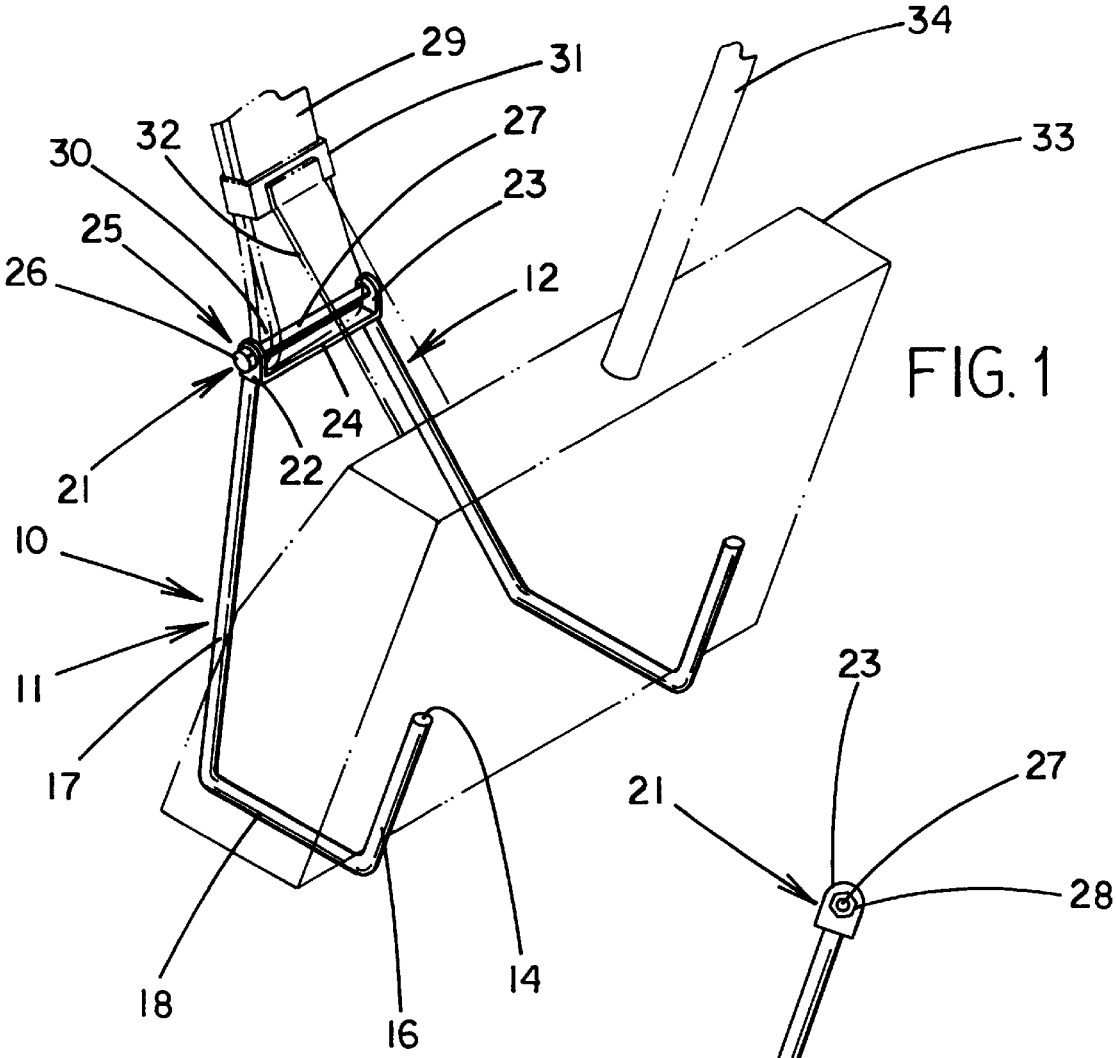
FIG. 1 is a schematic perspective view of a new remote controller holder according to the present invention.
Figure 2:
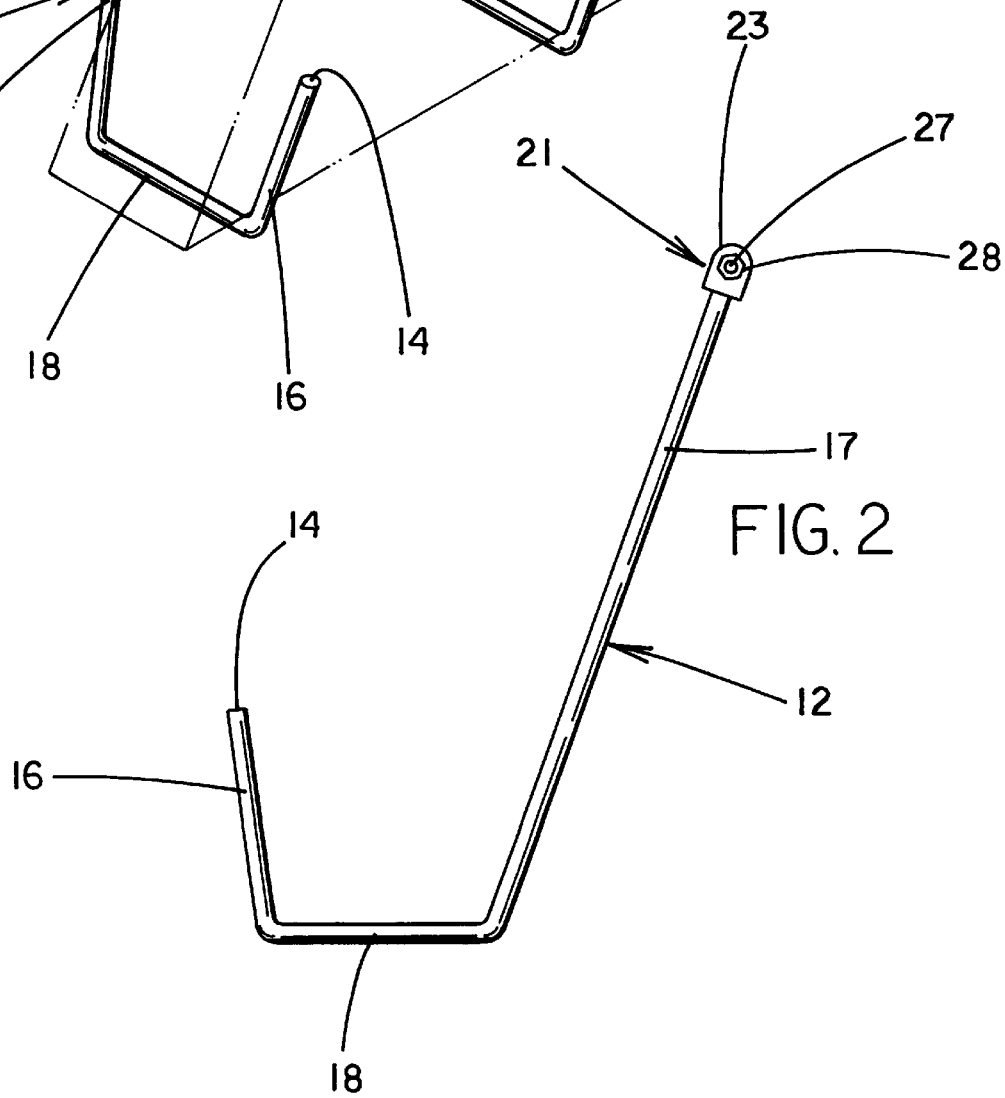
FIG. 2 is a schematic side view of the present invention.
Figure 3:
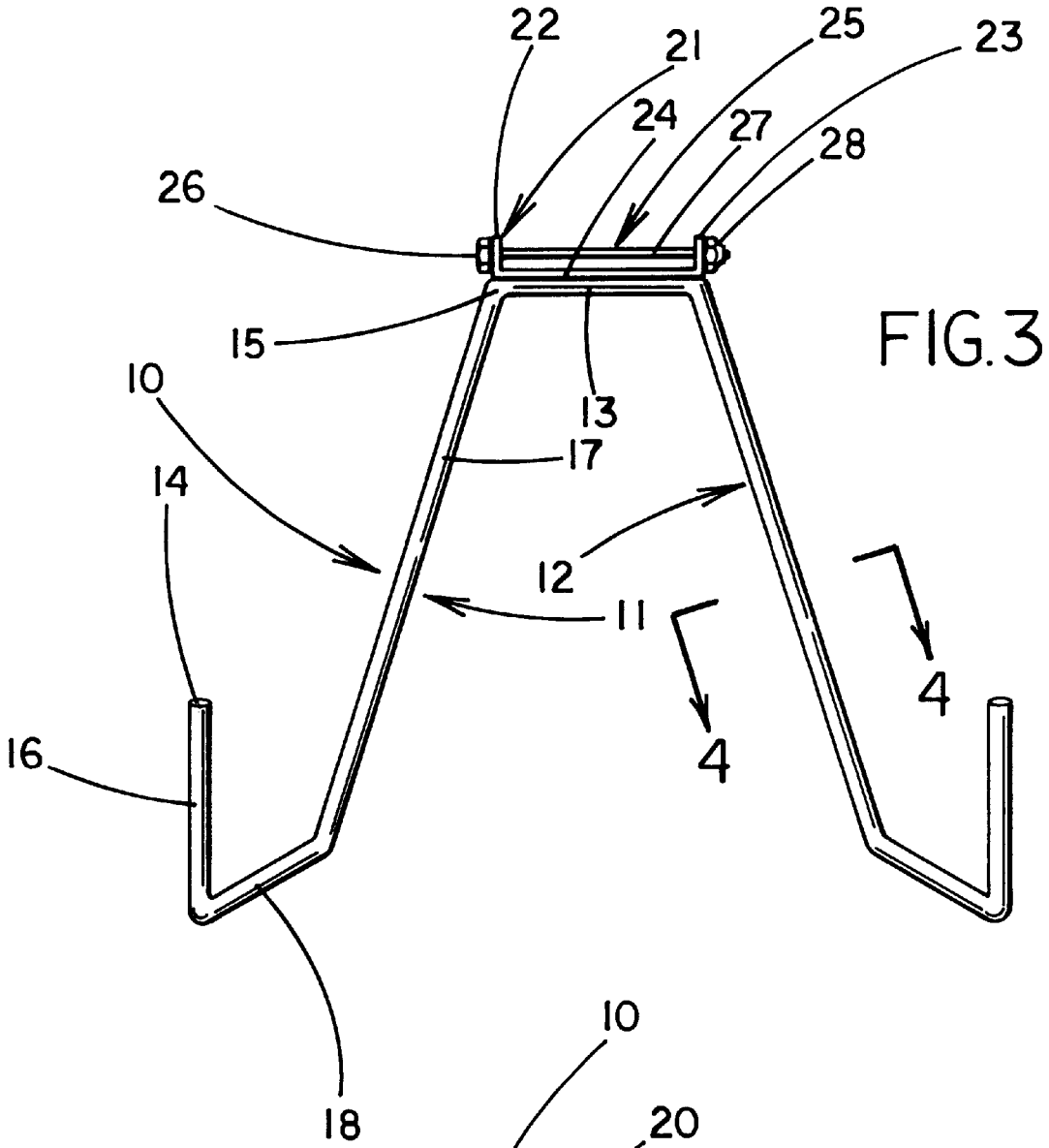
FIG. 3 is a schematic front perspective view of the present invention.

With reference now to the drawings, and in particular to FIGS. 1 through 4 thereof, a new remote controller holder embodying the principles and concepts of the present invention will be described.

As best illustrated in FIGS. 1 through 4, the remote controller holder generally comprises an elongate carrier having spaced apart pair of arm portions and an elongate middle portion connecting the arm portions together. The arm portions each have spaced apart elongate front and back segments, and an elongate bottom segment connecting the front and back segments of the respective arm portion together. The back segments of the arm portions are coupled to the middle portion. The arm portions are designed for resting a remote controller thereon. A generally U-shaped bracket is coupled to the middle portion of the elongate carrier. A bolt is extended through the bracket. The bolt is designed for extending through a looped end of a neck strap secured around a user's neck.

In closer detail, the holder includes an elongate carrier 10 having spaced apart pair of generally J-shaped arm portions 11,12 and an elongate middle portion 13 connecting the arm portions together.

The arm portions each have front and back ends 14,15. The back ends of the arm portions are coupled to opposite ends of the middle portion to connect the arm portions to the middle portion. The arm portions each also have spaced apart elongate front and back segments 16,17, and an elongate bottom segment 18 connecting the front and back segments of the respective arm portion together.

In one embodiment, the back segments of the arm portions are downwardly extended from the middle portion at substantially equal obtuse angles with respect to the middle portion. The back segments of the arm portions may also lie in a common plane with each other.

The bottom segment of each arm portion are forwardly extended from the back segment of the respective arm portion at an obtuse angle. The front segment of each arm portion is upwardly extended from the bottom segment of the respective arm portion at an obtuse angle which, one possible embodiment, may be less than the obtuse angle formed between the bottom and back segments of the respective arm portion.

In one embodiment, the front segment of each arm portion may have a length less than a length of the back segment of the respective arm portion. In such an embodiment, the front segment of each arm portion may also have a length about equal to that of the bottom segment of the respective arm portion.

In an illustrative embodiment, the length of the back segment of each arm portion may be about 3½ inches, the length of the bottom segment of each arm portion may be about 2 inches and the length of the front segment of each arm portion may be about 1 inch. In this illustrative embodiment, the length of the middle portion may be about 1¼ inches.

Figure 4:
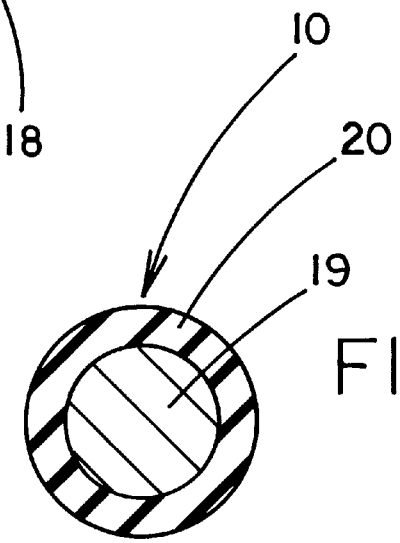
FIG. 4 is a schematic transverse cross sectional view taken from line 4—4 of FIG. 3.

The arm portions may also lie in planes extending at an acute angle to one another. Illustrative of such an embodiment, the bottom segments of the arm portions may be spaced apart from each other about 3½ inches adjacent the back segments and about 4½ inches adjacent the front segments As best illustrated in FIG. 4, the elongate carrier may have a generally circular transverse cross section and may also comprise a metal core 19 surrounded by a resiliently deformable rubber or plastic outer coating 20. In one such embodiment, the metal core may comprise a 12 gauge wire.

The holder also includes a generally U-shaped bracket 21 which is coupled to the middle portion of the elongate carrier. The bracket has a spaced apart pair of upwardly extending fingers 22,23 and a connecting portion 24 connecting the fingers of the bracket together. The connecting portion of the bracket is coupled to the middle portion of the elongate carrier to couple the bracket to the middle portion of the elongate carrier. The connecting portion may be welded or brazed to the middle portion.

A bolt 25 is also include having a head 26 and an elongate portion 27. The elongate portion of the bolt is extended through coaxial holes in the fingers of the bracket and spaced apart from the connecting portion. A nut 28 is threaded onto the elongate portion of the bolt such that the fingers are interposed between the head of the bolt and the nut to secure the bolt in place with respect to the fingers.

The holder is designed for use in conjunction with an elongate neck strap 29 designed for wear around a neck of a user. The neck strap has a looped end 30 for positioning adjacent a check of the user. The neck strap may also have an adjustment buckle 31 for selectively adjusting of the length of the neck strap.

As best illustrated in FIG. 1, the looped end of the neck strap is positioned between the fingers of the bracket so that the elongate portion of the bolt may be extended through the looped end of the neck strap.

A hook strap 32 may be coupled to the neck strap adjacent the looped end of the neck strap. The hook strap has a hook coupled to a free end of the hook strap.

The holder is designed for holding a remote controller for remotely controlling a remote controlled model such as a model airplane. The remote controller has a housing 33 which includes a face with a plurality of controller actuators thereon for actuating control of the remote controlled model and an antenna 34 outwardly extending from the housing. As illustrated in FIG. 1, the housing of the remote controller is rested on the bottom segments of the arm portions between the front and back segments of the arm portions and resting against the front segments of the arm portion. The face of the housing with the controller actuators faces the back segments, the antenna extending in an upwards direction away from the bottom segments. The hook is hooked on a loop or ring coupled to the face of the housing with the controller actuators.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A remote controller holding system for suspending a remote controller for a remote controlled model adjacent a user's torso, said system comprising;

an elongate carrier having spaced apart pair of arm portions and an elongate middle portion connecting said arm portions together;

said arm portions each having spaced apart elongate front and back segments, and an elongate bottom segment connecting said front and back segments of the respective arm portion together;

said back segments of said arm portions being coupled to said middle portion;

said arm portions being adapted for resting a remote controller thereon;

a generally U-shaped bracket being coupled to said middle portion of said elongate carrier;

a bolt being extended through said bracket, said bolt being adapted for extending through a looped end of a neck strap secured around a user's neck;

said looped end of said neck strap being positioned between a pair of fingers of said bracket, said elongate portion of said bolt being extended through said looped end of said neck strap;

a remote controller for remotely controlling a remote controlled model such as a model airplane, said remote controller having a housing; and said housing of said remote controller being rested on said bottom segments of said arm portions between said front and back segments of said arm portions and resting against said front segments of said arm portion.

2. The system of claim 1, wherein said back segments of said arm portions are downwardly extended from said middle portion at equal obtuse angles with respect to said middle portion.

3. The system of claim 2, wherein said back segments of said arm portions lie in a common plane with each other.

4. The system of claim 3, wherein said bottom segment of each arm portion are forwardly extended from said back segment of the respective arm portion at an obtuse angle.

5. The system of claim 4, wherein said front segment of each arm portion is upwardly extended from said bottom segment of the respective arm portion at an obtuse angle less than said obtuse angle formed between said bottom and back segments of the respective arm portion.

6. The system of claim 1, wherein said arm portions lie in planes extending at an acute angle to one another.

7. A remote controller holding system, comprising:

a holder, comprising:

a elongate carrier having spaced apart pair of arm portions and an elongate middle portion connecting said arm portions together;

said arm portions each front and back ends, said back ends of said arm portions being coupled to opposite ends of said middle portion to connect said arm portions to said middle portion;

said arm portions each having spaced apart elongate front and back segments, and an elongate bottom segment connecting said front and back segments of the respective arm portion together;

said back segments of said arm portions being downwardly extended from said middle portion at substantially equal obtuse angles with respect to said middle portion;

said back segments of said arm portions lying in a common plane with each other;

said bottom segment of each arm portion being forwardly extended from said back segment of the respective arm portion at an obtuse angle;

said front segment of each arm portion being upwardly extended from said bottom segment of the respective arm portion at an obtuse angle less than said obtuse angle formed between said bottom and back segments of the respective arm portion;

said front segment of each arm portion having a length less than a length of said back segment of the respective arm portion;

said front segment of each arm portion having a length about equal to that of said bottom segment of the respective arm portion;

said arm portions lying in planes extending at an acute angle to one another;

a generally U-shaped bracket being coupled to said middle portion of said elongate carrier;

said bracket having a spaced apart pair of upwardly extending fingers and a connecting portion connecting said fingers of said bracket together;

said connecting portion of said bracket being coupled to said middle portion of said elongate carrier to couple said bracket to said middle portion of said elongate carrier;

a bolt having a head and an elongate portion, said elongate portion of said bolt being extended through said fingers of said bracket and spaced apart from said connecting portion;

a nut being threaded onto said elongate portion of said bolt such that said fingers are interposed between said head of said bolt and said nut to secure said bolt in place with respect to said fingers;

an elongate neck strap for being worn around a neck of a user, said neck strap having a looped end for positioning adjacent a chest of the user;

said neck strap having an adjustment buckle for selectively adjusting of said length of said neck strap;

said looped end of said neck strap being positioned between said fingers of said bracket, said elongate portion of said bolt being extended through said looped end of said neck strap;

a hook strap being coupled to said neck strap adjacent said looped end of said neck strap;

a remote controller having a housing resting on said bottom segments of said arm portions between said front and back segments of said arm portions and resting against said front segments of said arm portion for tilting said housing with respect to the chest of the user; and wherein each of said front segments, each of said back segments and each of said bottom segments of each arm portion are substantially straight such that said housing of said remote controller simultaneously contacts said length each of said front segment and said length of said bottom segment for facilitating stability of said remote controller in said carrier.

8. The holder of claim 7, wherein said length of said back segment of each arm portion is about 3½ inches, said length of said bottom segment of each arm portion is about 2 inches and said length of said front segment of each arm portion is about 1 inch;

wherein said length of said middle portion is about 1¼ inches;

wherein said bottom segments of said arms are spaced apart from each other about 3½ inches adjacent said back segments and about 4½ inches adjacent said front segments.

9. The holder of claim 7, wherein said elongate member having a generally circular transverse cross section and comprising a metal core surrounded by a resiliently deformable rubber or plastic outer coating; wherein said metal core comprises 12 gauge wire.

10. The holder of claim 1, wherein each of said front segments, each of said back segments and each of said bottom segments of each arm portion are substantially straight such that the remote controller simultaneously contacts a length of each of said front segments and a length of each of said bottom segments for facilitating stability of the remote controller in said carrier.

11. The holder of claim 1, wherein said neck strap has an adjustment buckle for selectively adjusting a length of said neck strap.

12. The holder of claim 1, wherein a hook strap being coupled to said neck strap adjacent said looped end of said neck strap, wherein said hook strap has a hook coupled to a free end of said hook strap.

* * * * *